United States Patent [19]

Mischakoff

[11] Patent Number: 4,464,970

[45] Date of Patent: Aug. 14, 1984

[54] GUITAR BRIDGE SYSTEM

[76] Inventor: Matthew Mischakoff, 3446 Brassow Rd., Saline, Mich. 48176

[21] Appl. No.: 434,824

[22] Filed: Oct. 18, 1982

[51] Int. Cl.[3] ..... G10D 3/04

[52] U.S. Cl. ..... 84/298; 84/277; 84/314 N

[58] Field of Search ..... 84/277, 298, 299, 307, 84/314 N

[56] References Cited

U.S. PATENT DOCUMENTS

| | | | |
|---|---|---|---|
| 490,528 | 1/1893 | Wooster . | |
| 582,030 | 5/1897 | Walker | 84/314 N |
| 668,060 | 2/1901 | Shelton | 84/314 N |
| 688,272 | 12/1901 | Truax . | |
| 766,049 | 7/1904 | Loppentien | 84/277 X |
| 934,678 | 9/1909 | Laurian . | |
| 1,138,803 | 5/1915 | Shutt . | |
| 1,559,657 | 11/1925 | Todd | 84/277 |
| 1,599,184 | 9/1926 | Polychronis | 84/314 N |
| 1,649,376 | 11/1927 | Bacon et al. . | |
| 2,162,595 | 6/1939 | Virzi | 84/277 |
| 2,309,082 | 1/1943 | Smith et al. | 84/314 N |
| 2,491,788 | 12/1949 | Widowson | 84/299 |
| 3,178,985 | 4/1965 | Jeranson | 84/307 |
| 4,208,941 | 6/1980 | Wechter | 84/298 |

FOREIGN PATENT DOCUMENTS

| | | | |
|---|---|---|---|
| 9485 | of 1890 | United Kingdom | 84/291 |

*Primary Examiner*—Lawrence R. Franklin

*Attorney, Agent, or Firm*—Beaman & Beaman

[57] ABSTRACT

The invention pertains to improvements in stringed instruments, and particularly relates to the string supporting apparatus for guitars, such as the bridge system. A plurality of string rests are located within the bridge slot, and the rests are provided with an upper obliquely oriented surface having string receiving notches therein whereby the height of the string above the guitar neck may be adjusted. Further, the upper portion of the string rest may be offset from its base region wherein the location of rest engagement with the string may be adjusted to selectively lengthen or shorten the string. Further, a string rest adapted to be located adjacent the guitar neck nut is disclosed whereby the string height may be varied, and the string length adjusted. A further feature of the invention pertains to the internal bracing of the guitar front and rear panels.

6 Claims, 15 Drawing Figures

GUITAR BRIDGE SYSTEM

BACKGROUND OF THE INVENTION

The acoustical characteristics of stringed instruments, such as guitars, and in particular, classical guitars which are not electronically augmented, are affected by the length of the strings producing the sound vibrations. Accurate tuning of the string cannot solely be regulated by adjusting the string tension, and the points of support of the string are also critical and significantly affect the pitch produced.

String vibrations are transmitted to the guitar front panel through a bridge affixed to the front panel, and bridge arrangements are known whereby the point of location of string support at the bridge may be adjusted to lengthen or shorten the string unsupported length. For instance, adjustable string supporting bridges are shown in U.S. Pat. Nos. 490,528; 688,272; 934,678; 1,138,803; 2,491,788; 3,178,985 and 4,208,941. While the string rests shown in the prior art, such as the aforementioned patents, permit adjustment of the effective string length, the bridges are of a custom construction to support the particular rests disclosed, and the inventive concepts shown in these patents cannot readily be applied to existing guitars with standard bridge systems.

It is an object of the invention to provide a guitar bridge system utilizing a plurality of individual string rests wherein the rests are compatible with standard guitar bridges and no modification to the bridge is required to use the string rests of the invention.

A further object of the invention is to provide a rest for stringed instruments wherein the rest is compatible with standard guitar bridge configurations, and the rests permit the string to be supported at selective heights from the guitar front panel and fingerboard or neck.

Another object of the invention is to provide a rest for a stringed instrument of a simple form wherein the rest is compatible with standard bridge configurations and is capable of lengthening or shortening the effective string length, as well as determining the height of the string.

A further object of the invention is to provide a string rest for guitars wherein the rest is located adjacent the neck nut and is capable of supporting a string at a predetermined height above the fingerboard, and simultaneously shorten the effective string length.

An additional object of the invention is to provide an internal bracing system for guitars interposed between the front and rear panels to improve the acoustical and structural characteristics, such bracing capable of being installed after the guitar is assembled.

In the practice of the invention a standard classical guitar includes a bridge affixed to the front panel having an elongated slot defined therein. The bridge includes anchor means for holding the ends of the string, and rests are defined upon the bridge over which the strings pass and are supported. In accord with the invention the string rests include a lower base region firmly received within the bridge slot for selective positioning therein, and the rests include an upper portion which engages and supports the strings passing thereover. The upper edge of the rests is obliquely oriented to the length of the slot and notches are defined in the rests' upper edge for receiving and holding the string in the desired position.

Further, the string rests' upper portion may also be offset with respect to the base region wherein the location of string support at the rest upper edge is offset "forwardly" or "rearwardly" with respect to the rest base region. This offset will increase or shorten the effective string length depending on whether the rest offset portion extends in the direction of the neck, or away therefrom.

In accord with the invention the string length may also be shortened by the use of a string rest supported upon the string neck adjacent the nut located at the outer end of the neck. This string rest includes a flat bottom surface for engaging the guitar neck, and the upper surface is obliquely oriented to the bottom surface having string receiving notches defined therein wherein a string supported by a notch will be maintained above the neck at the height determined by the associated notch. This rest may be moved along the neck toward and away from the bridge, and thereby effectively vary the length of the vibrating portion of the string, and also, this rest will adjust the height of the string above the neck adjacent the nut.

The tonal character of a guitar is affected by the vibration characteristics of the front and rear panels, and such characteristics can often be improved in an acoustical guitar by the imposition of reinforcing or bracing structure intermediate the front and rear panels. In accord with the invention a prop of elongated form having shaped ends is interposed between reinforcing ribs supporting the front and rear panels, and the length of the prop may be varied by screw means to adjust the degree of compression within the prop.

The aforementioned apparatus permits guitars and similar stringed instruments to be more finely tuned than is possible with merely varying the string tension, and as the string rests and prop are readily usable with standard guitar constructions no modification to the guitar is required to employ the inventive principles.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
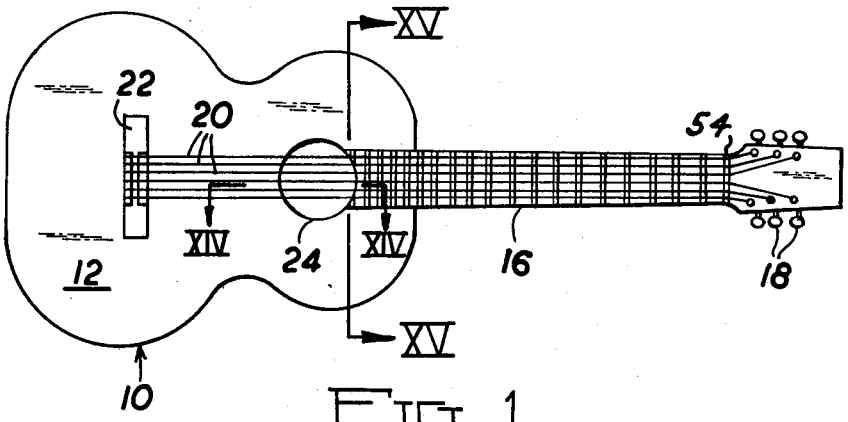
FIG. 1 is a plan view of an acoustical guitar utilizing the concepts of the invention.
Figure 14:
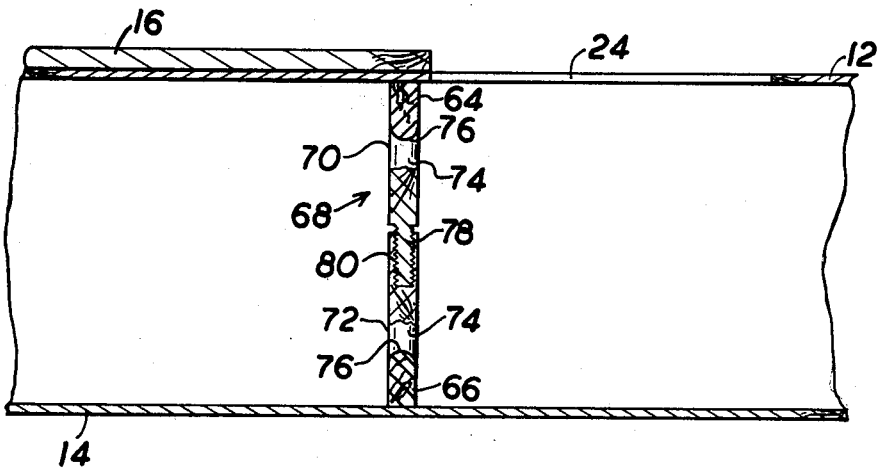
FIG. 14 is a detail enlarged elevational sectional view through the guitar body as taken along Section XIV—XIV of FIG. 1.

The inventive concepts can be utilized with a variety of string instruments but are particularly suitable for use with classical guitars, and such a guitar is illustrated in FIG. 1 wherein the guitar body is represented at 10, and includes a wood front panel 12, and rear panel 14, FIG. 14. The guitar includes the usual neck 16 upon which the string tighteners 18 are mounted, and the other ends of the strings 20 are anchored to the bridge 22 affixed to the front panel. The front panel 12 includes the usual acoustical opening 24.

Figure 2:
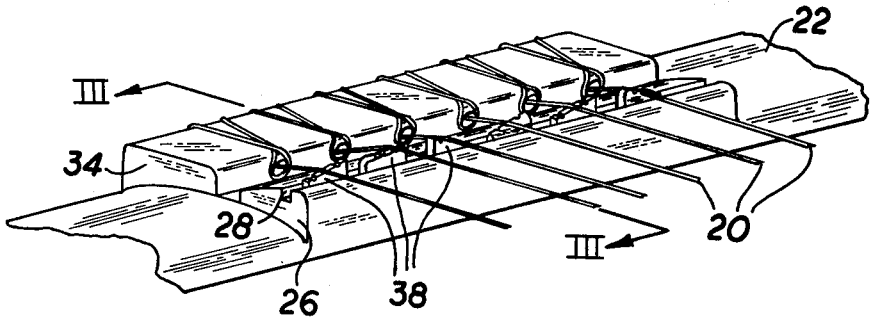
FIG. 2 is an enlarged perspective view of a guitar bridge utilizing the improved string rests.
Figure 3:
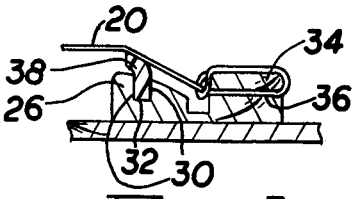
FIG. 3 is an end view of the bridge of FIG. 2.

The configuration of the bridge 22 is best appreciated from FIGS. 2 and 3, and includes a portion 26 having a slot 28 defined therein, the slot consisting of parallel spaced sides 30 and a base surface 32. The length of the slot is at right angles to the length of the strings 20. The bridge 22 also includes a string anchor portion 34 in which a hole 36 is defined through which a string is received, and the string is reversed and tied under itself in a manner as represented in FIG. 3.

String rest structure is normally supported within the bridge slot 28, and in accord with the invention, the rest supporting the strings 20 consists of a plurality of synthetic plastic rest elements 38 formed of a sheet material. The string rests each include a flat base surface 40 and parallel spaced sides 42 which are closely received within the bridge slot 28, the rest sides 42 engaging the slot sides 30, and the rest bottom 40 engaging the slot surface 32. As apparent in FIG. 4, the rest base region 44 received within slot 28 will be firmly supported within the slot.

The upper region 46 of the string rest 38 includes an upper surface 48 which is obliquely related to the surface 40. A plurality of string receiving notches 50 are defined within the surface 48 extending thereacross and intersecting the sides 42, as will be appreciated from FIG. 5. Of course, as a separate string rest is utilized with each string, only one of the notches 50 is employed at a time, and the string rest 38 will be positioned within the bridge slot such that the desired notch will be aligned with the string. Due to the oblique orientation of the rest surface 48 the spacing between the three notches illustrated and the rest surface 40 differs, and depending upon which notch is associated with the string the vertical spacing or height of the string relative to the guitar front panel and neck is selectively adjustable.

Figure 4:
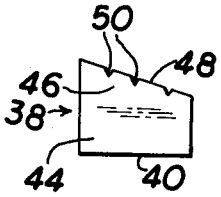
FIG. 4 is an elevational view of a flat bridge string rest.
Figure 5:
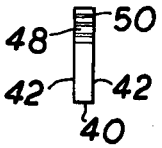
FIG. 5 is an end view of the string rest of FIG. 4 as taken from the right thereof.

As the unsupported length of the string is important to producing the desired playing and intonation characteristics of the string, variations of the rest configuration from the "flat" form shown in FIGS. 4 and 5, provide such adjustment. With respect to the rest of FIGS. 6 and 7 wherein the primed reference numerals are used with similar features previously described, the rest upper portion 46′ is offset with respect to the base region 44′ and the notches 50′ formed in the upper portion of the offset portion 46′ will position the string relative to the associated rest as desired. The rest portion 46′ may be provided with clearance slots 52 in alignment with string notches 50′ so as not to interfere with the vibration transmitting character of the string rest.

Figure 6:
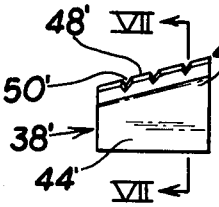
FIG. 6 is an elevational view of a bridge string rest having an offset upper portion.
Figure 7:
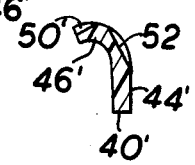
FIG. 7 is an end view of the string rest of FIG. 6 as taken from the right thereof.
Figure 8:
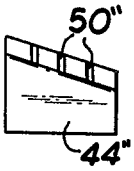
FIG. 8 is an elevational view of a bridge string rest of modified form having an offset upper portion.
Figure 9:
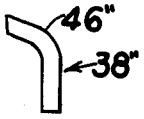
FIG. 9 is an end view of the string rest of FIG. 8 as taken from the right thereof.
Figure 10:
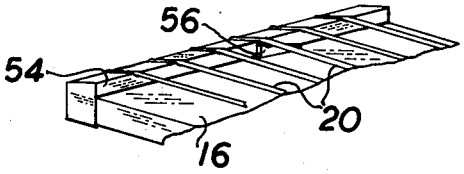
FIG. 10 is an enlarged, detail perspective view of a guitar neck and nut illustrating a neck supported string rest in accord with the invention.
Figure 11:
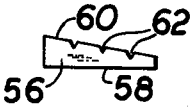
FIG. 11 is an elevational view of the string rest shown in FIG. 10.
Figure 12:
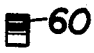
FIG. 12 is an end elevational view of the string rest of FIG. 11 as taken from the right of FIG. 11.
Figure 13:
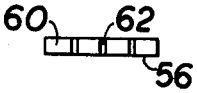
FIG. 13 is a top plan view of the string rest of FIG. 11.

When using the rest shown in FIGS. 6 and 7, or shown in FIGS. 8 and 9, the effective length of the string is varied depending upon whether the string rest is installed within the bridge slot 28 so that the offset portion 46′ extends toward the neck 16, or away therefrom. If the offset portion extends toward the guitar neck the string length is shortened, while the string length will be lengthened if the rest is installed with the offset portion extending toward the bridge anchor portion 34.

The string rest embodiment of FIGS. 8 and 9 is somewhat similar to that shown in FIGS. 6 and 7, except that the offset portion 46″ is modified in configuration, yet the location of the string relative to the rest will also be offset with respect to the base region, permitting variation in the string length.

The effective string length can also be varied by utilizing a neck supported string rest as shown in FIGS. 10–13. This string rest will usually be located adjacent the neck nut 54 over which the strings pass, and the nut will determine the height of the outer ends of the string above the neck surface and frets. The string rest 56 is formed of a synthetic plastic material having a flat bottom surface 58 which engages the neck surface and supports the rest thereon. The rest includes an upper oblique surface 60 in which the string receiving notches 62 are formed, three being shown in the illustrated embodiment, and the rest 56 is slipped under the appropriate string 20 and the string is located in the desired notch, and the compression imposed upon the rest by the string will firmly hold the rest against the neck. The vertical height of the supported string above the neck will be determined by which notch 62 the string is received within, and by sliding the rest along the neck in the direction of the strings the unsupported length of the string may be adjusted to adjust the intonation thereof.

Figure 15:
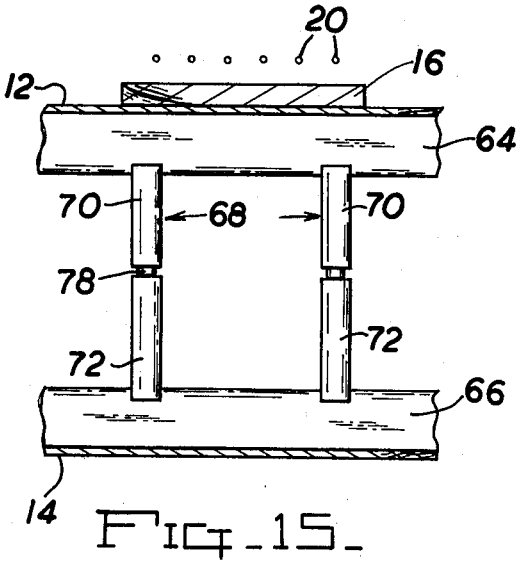
FIG. 15 is an enlarged elevational detail sectional view of the guitar body as taken along Section XV—XV of FIG. 1.

The tonal and structural character of a guitar can also be improved by internally bracing or reinforcing the front and rear panels 12 and 14, respectively, and the concepts of the invention in this regard will be appreciated with reference to FIGS. 14 and 15. Internally, wood ribs 64 are affixed to the underside of the front panel 12 at spaced locations and extend transversely to the length of the neck 16. Likewise, a plurality of wood ribs 66 are also bonded to the inside surface of the rear panel 14 oriented in a similar manner, and the ribs 64 and 66 are normally located in spaced opposed relationship to each other. In accord with the invention, a prop, and preferably two props, are interposed between the ribs 64 and 66 and placed under compression wherein the front and rear panels reinforce each other. In the disclosed embodiment the prop 68 may be formed of wood and consists of two portions 70 and 72, each of an elongated form having ends 74. The ends are formed with a concave surface 76 to be complimentary to the convex inner surfaces of the ribs 64 and 66, wherein an intermating between the ribs and prop occur to aid in holding the prop in position. The length of the prop can be varied by the use of a threaded stud 78 defined on the prop portion 70 which is screwed into a threaded hole 80 defined in the prop portion 72.

In use, the overall length of the prop 68 is adjusted by rotating portion 70 relative to portion 72 and the screw interconnection will permit the length to be accurately adjusted. Thereupon, the prop is inserted through the guitar opening 24 and tilted with respect to the planes of the panels 12 and 14 in order to permit insertion of the props between the ribs 64 and 66 and permit the prop ends to mate with the convex surfaces of the ribs. Thereupon, the prop is tapped adjacent a rib to orient the prop at right angles to the length of the ribs, and this action will place the prop under tension and provide the desired interconnection between the front and rear panels. The second prop, as illustrated in FIG. 15, is likewise installed.

It is to be appreciated that the props 68 can be formed of a single nonadjustable length, or other types of threaded interconnections between prop portions may be utilized, such as a turnbuckle arrangement.

It is appreciated that various modifications to the inventive concepts may be apparent to those skilled in the art without departing from the spirit and scope of the invention.

I claim:

1. A bridge system for a multiple stringed instrument wherein the bridge includes an elongated slot having substantially parallel spaced sides, the improvement comprising, a plurality of string rests supported within the bridge slot, each rest supporting a separate string, said rests each including end edges, a base region having spaced parallel sides closely received within the bridge slot and an upper string engaging region extending between said end edges, said upper region including an upper edge having a plurality of string engagable notches defined therein, the spacing of said notches from said base region varying whereby the spacing of a supported string from the bridge slot may be selectively adjusted.

2. In a bridge system as in claim 1, said rest upper edge being obliquely oriented with respect to said base region whereby the spacing of said notches from said base region increases from one rest end edge to the other end edge.

3. In a bridge system as in claim 2 wherein said rest upper region is offset with respect to said lower region whereby said notches are selectively positionable with respect to the bridge slot.

4. In a bridge system as in claim 2, said rest being formed of a synthetic plastic body of sheet material.

5. A string support for varying the unsupported length of a single string of a stringed instrument wherein the string support rests upon the instrument neck and may be moved thereon, comprising, in combination, a body having a flat bottom surface, an upper surface, ends and sides, said body adapted to be supported upon the instrument neck upon said bottom surface, said upper surface being obliquely related to said bottom surface, and a plurality of spaced string receivable notches defined in said upper surface whereby the distance between each notch and said bottom surface varies.

6. In a string support as in claim 5, said notches being parallel to each other and intersecting said body sides.

* * * * *